United States Patent [19]

Fukuoka

[11] 4,424,416

[45] Jan. 3, 1984

[54] ACOUSTIC REPRODUCING APPARATUS

[75] Inventor: Norio Fukuoka, Hachioji, Japan

[73] Assignee: Olympus Optical Company Ltd., Tokyo, Japan

[21] Appl. No.: 269,347

[22] Filed: Jun. 1, 1981

[30] Foreign Application Priority Data

Aug. 22, 1980 [JP] Japan ..... 55-118771[U]

[51] Int. Cl.[3] ..... H04R 5/02

[52] U.S. Cl. ..... 381/24; 381/98; 181/146

[58] Field of Search ..... 179/1 D, 1 E, 1 G, 1 GA, 179/82, 146 E, 181 W; 181/146, 151

[56] References Cited

U.S. PATENT DOCUMENTS

| | | | |
|---|---|---|---|
| 3,094,587 | 6/1963 | Dow | 179/1 G |
| 3,135,349 | 6/1964 | Lahti | 179/146 E |
| 3,892,624 | 7/1975 | Shimada | 179/1 G |
| 3,941,931 | 3/1976 | Osakabe | 179/1 G |
| 3,999,020 | 12/1976 | Bastiaans et al. | 179/1 D |
| 4,097,689 | 6/1978 | Yamada et al. | 179/1 G |
| 4,191,852 | 3/1980 | Nishikawa | 179/1 G |
| 4,218,583 | 8/1980 | Poulo | 179/1 GA |
| 4,365,688 | 12/1982 | Blose | 181/146 X |

*Primary Examiner*—A. D. Pellinen

*Attorney, Agent, or Firm*—Weinstein & Sutton

[57] ABSTRACT

An acoustic reproducing apparatus is provided which includes first and second channels and first and second speakers, all disposed in a housing with a sound path for acoustically coupling the first and second speakers. The sound path has disposed therein sound absorbing material which forms a low pass filter which operates to add the low frequency signal component of the first channel to the second channel and also operates to add the low frequency signal component of the second channel to the first channel to produce a composite low frequency signal with greater amplitude which is reproduced in phase by each of the first and second speakers.

1 Claim, 6 Drawing Figures

ACOUSTIC REPRODUCING APPARATUS

BACKGROUND OF THE INVENTION

The invention relates to an acoustic reproducing apparatus, and more particularly, to such apparatus for use in a portable stereophonic reproducing unit utilizing small size loudspeakers in which the low frequency response is improved.

A stereophonic reproducing apparatus commonly used in the prior art is constructed in a manner as illustrated in FIG. 1. Specifically, left and right channel audio signals are applied to respective input terminals 1, 2. The left channel signal is routed through a path including a volume control 3, an amplifier 5 and a loudspeaker 7 while the right channel signal is routed through a path including a volume control 4, an amplifier 6 and a loudspeaker 8. In this manner, the both channel signals are independently reproduced by the left- and the right-hand loudspeakers 7, 8, respectively, allowing a listener who is situated between them to enjoy the reproduction with a stereophonic effect. In a small size portable stereophonic apparatus which utilizes a micro-cassette tape, the limited size of the apparatus prevents the use of loudspeakers of a size which is sufficient to produce an excellent low frequency response. As a result, with such apparatus, it is difficult to provide the reproduction of a low frequency range with sufficient level, as compared with the reproduction of a high frequency range. This prevents a reproduction with massive sensation as may be obtained with a larger apparatus. It is contemplated that the low frequency response may be improved and associated volume effect increased by the addition of a tone control or loudness control circuit in the electrical circuit, thus providing a bass boosting. However, this requires an increased power in a power amplifier. Nevertheless, if loudspeakers of a reduced size are utilized, the bass boosting merely results in increasing the distortion in the low frequency range without substantially improving the low frequency response. Hence, such approach cannot be adopted in a stereophonic apparatus of a small size. Alternatively, low frequency signals from both channels may be synthesized for reproduction by a single, devoted low frequency loudspeaker so as to provide a so-called 3D (three dimension) arrangement which is employed usually in home stereophonic apparatus, but this requires the provision of three loudspeakers, which does not lend itself for use in a small size and inexpensive portable stereophonic apparatus.

SUMMARY OF THE INVENTION

In view of the foregoing, it is an object of the invention to provide an acoustic reproducing apparatus in which low frequency signals from both channels are additively synthesized to provide a composite low frequency signal which is fed to the left and right loudspeaker together with independent left and right channel signals for the medium and the high frequency range so that the both loudspeakers are driven in phase for the low frequency range to thereby substantially enhance the acoustic radiation area for the low frequency range.

In accordance with the invention, for the low frequency range, the both channel signals are added together to be simultaneously reproduced by the left- and the right-hand loudspeaker, thereby multiplying the reproduced radiation energy to improve the volume effect in the low frequency range.

In the arrangement of the invention, the power dissipation is less and the electrical circuit is simplified and inexpensive as compared with the use of the bass boosting technique or low frequency loudspeaker. Hence, a small size apparatus can be inexpensively provided.

DESCRIPTION OF PREFERRED EMBODIMENTS

Figure 2:
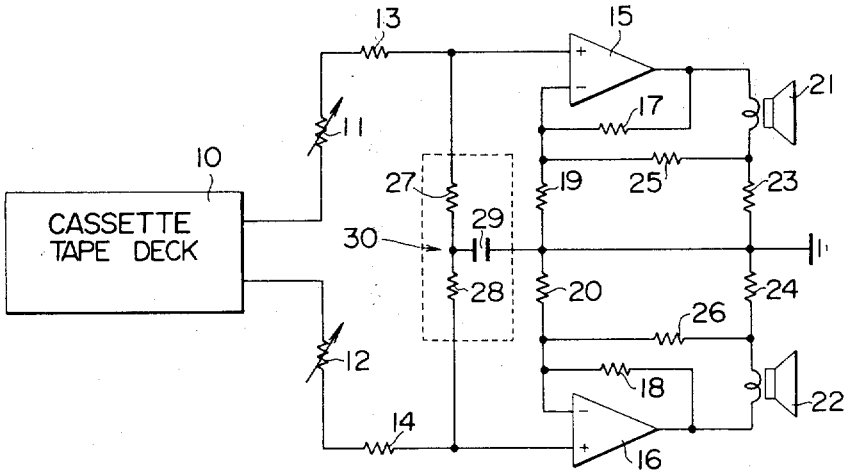
PRIOR ART FIG. 2
FIG. 2 is a circuit diagram of an acoustic reproducing apparatus according to one embodiment of the invention in which the synthesis of low frequency signals from the both channels is electrically performed.

Referring to FIG. 2, there is shown a cassette tape deck 10 for a stereophonic micro-cassette having a left channel (hereafter referred to as L channel) output terminal which is connected through a volume control 11 and a series resistor 13 to the positive input terminal of a power amplifier 15. The output terminal of the amplifier 15 is connected through a resistor 17 to the negative input terminal of the amplifier 15 and thence to the ground through a resistor 19. The output terminal of the amplifier 15 is also connected to the ground through an L channel loudspeaker 21 and a series resistor 23. A resistor 25 is connected across the junction between the loudspeaker 21 and the resistor 23 and the negative input terminal of the amplifier 15.

The right channel (hereafter referred to as R channel) of the reproducing apparatus is similarly constructed. Specifically, the R channel output terminal of the tape deck 10 is connected through a volume control 12 and a resistor 14 to the positive input terminal of a power amplifier 16. The output terminal of the amplifier 16 is connected through a resistor 18 to the negative input terminal thereof and thence connected to the ground through a resistor 20. The output terminal of the amplifier 16 is also connected to the ground through an R channel loudspeaker 22 and resistor 24. A resistor 26 is connected across the junction between the loudspeaker 22 and the resistor 24 and the negative input terminal of the amplifier 16.

A pair of resistors 27, 28 are connected in series across the positive input terminals of the power amplifiers 15 and 16, with the junction therebetween connected to the ground through a capacitor 29. The resistors 27, 28 and the capacitor 29 form together a low pass filter 30 which is operative to additively synthesize only low frequency components of audio signals fed to the amplifiers 15, 16. The frequency response of the low pass filter 30 is experimentally determined to provide an effective enhancement of the reproduced sound pressure for the low frequency range as consistent with preventing a detraction from the stereophonic effect produced by the reproduction from the loudspeakers 21, 22. When loudspeakers 21, 22 have an aperture diameter on the order of 3 to 4 inches, the filter 30 may have −3 dB cutoff frequency which is around 100 to 200 Hz, for example. The low pass filter 30 used exhibits −6 dB/oct, but other low pass filters may be used as by forming a suitable CR filter of the $\pi$-type exhibiting −12 dB/oct or a higher slope.

In the described apparatus, the audio signals of both L and R channels derived from the output terminals of the tape deck 10 are passed through volume controls 11, 12, and resistors 13, 14 to the power amplifiers 15, 16. The medium and high frequency components of the L channel are fed to the L channel amplifier 15, and the medium and high frequency components of the R channel signal are separately fed to the R channel amplifier 16 to be amplified therein. However, for the low frequency range, the both channel signals are additively synthesized by the low pass filter 30. Thus the low frequency component of the L channel is applied to the L channel amplifier 15 and simultaneously to the R channel amplifier 16. Conversely, the low frequency component of the R channel is applied to the R channel amplifier 16 and simultaneously to the L channel amplifier 15. Consequently, the loudspeakers 21, 22 are driven in phase for a low frequency range below a particular frequency which is determined by the response of the low pass filter 30. This is equivalent to doubling the effective low frequency radiation area from the loudspeakers, thus multiplying the radiation energy for the low frequency range and enhancing the volume effect of the reproduction. It is to be noted that the synthesis of low frequency components from the both channels presents no difficulty to the listener since the directivity is reduced in the low frequency range as compared with the medium and high frequency range, thus presenting less contribution to the stereophonic effect by tones in the low frequency range.

On the other hand, in the medium and high frequency range which exceed the particular frequency, there takes place no synthesis of signals from the both channels, thus preventing the stereophonic effect from being detracted.

In the electrical circuit shown in FIG. 2, a negative current feedback is applied by the use of resistors 23, 25, 19 and resistors 24, 26, 20, thus increasing the output impedance of the power amplifiers 15, 16. When dynamic loudspeakers are used for the loudspeakers 21, 22, they will exhibit an extremely high impedance at a minimum resonance frequency $f_0$, and hence the increased value of the output impedance of the amplifiers 15, 16 produces an increased voltage across the loudspeakers 21, 22 at the minimum resonance frequency $f_0$, thus effectively contributing to increasing the sound pressure from the loudspeakers 21, 22.

The use of impedance elements such as resistors 27, 28 in the low pass filter 30 produce a loss in the low frequency components of the both channels as they pass through the low pass filter 30. Accordingly, a more effective bass reproduction can be assured by employing an amplifier to compensate for the loss of the low frequency components.

Figure 3:
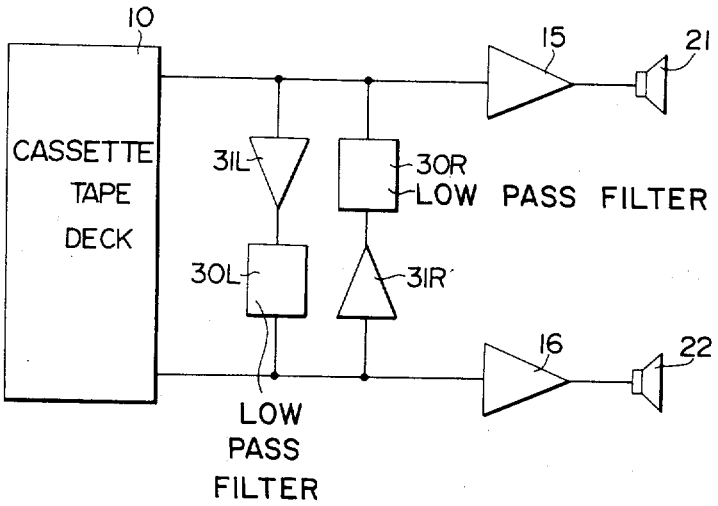
FIG. 3 is a circuit diagram of an acoustic reproducing apparatus according to another embodiment of the invention in which the synthesis of low frequency signals from the both channels is electrically performed.
Figure 4:
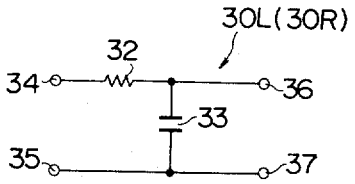
FIG. 4 is a circuit diagram of a low pass filter of the apparatus shown in FIG. 3.

FIG. 3 is a circuit diagram of an acoustic reproducing apparatus which takes this into consideration. In this Figure, the L channel output terminal of the tape deck 10 is connected to the input terminal of the L channel power amplifier 15 and is also connected to the input terminal of the power amplifier 16 through an amplifier 31L and a low pass filter 30L. Similarly, the R channel output terminal of the tape deck 10 is connected to the input terminal of the R channel power amplifier 16 directly, and is also connected to the input terminal of the L channel amplifier 15 through an amplifier 31R and a low pass filter 30R. Each of the filters 30L, 30R may be constructed as shown in FIG. 4. Specifically, a combination of series connected resistor 32 and capacitor 33 have their opposite ends connected to input terminals 34, 35 while the opposite ends of the capacitor 33 are connected to output terminals 36, 37. It will be understood that these filters 30L, 30R pass only low frequency components of the L and R channel audio signals from the deck 10 to the amplifier 15 or 16 of the other channel. The presence of resistor 32 in each filter produces a loss in the audio signal as the latter passes through the filter. To compensate for this loss, the filters 30L, 30R are preceded by the respective devoted amplifiers 31L or 31R, thus providing a suitable amplification of the low frequency signal from either L or R channel fed from the low pass filter 30L or 30R to the other power amplifier 16 or 15. As a result of such amplification, the low frequency components from both L and R channels are uniformly synthesized in a balanced manner within the both power amplifiers 15, 16, with the result that the low frequency output from these amplifiers 15, 16 increases to permit the both loudspeakers 21, 22 to produce a bass with sufficient amplitude. If the gain of the amplifiers 31L, 31R is increased excessively, there results a positive feedback around the both amplifiers 31L, 31R, causing an oscillation thereof. Therefore, it is necessary that the gain of the amplifiers 31L, 31R be limited to a value which is sufficient to compensate for the loss of the low frequency components in the filters 30L, 30R.

Figure 5:
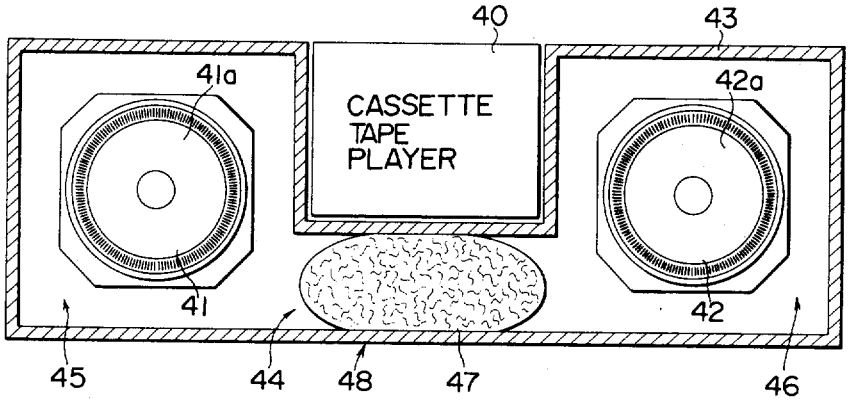
FIG. 5 is a cross section of an acoustic reproducing apparatus according to a further embodiment of the invention in which the synthesis of low frequency signals from the both channels is acoustically achieved.

While the described embodiments are directed to an electrical synthesis of low frequency components from the both channels, it should be understood that the invention is not limited thereto, but an acoustical synthesis of low frequency components may be achieved as illustrated by an embodiment shown in FIG. 5.

Referring to FIG. 5, an acoustic reproducing apparatus comprises a cassette tape player 40 including a micro-cassette tape playback mechanism and an electrical playback circuit, and a single enclosed cabinet 43 having a pair of loudspeakers 41, 42 mounted therein for stereophonically reproducing outputs from the player 40. The loudspeakers 41, 42 are disposed along the opposite lateral sides of the cabinet 43, and are mounted on a front plate, not shown. An intermediate portion of the cabinet 43 receives the cassette tape player 40, thus leaving a space 44 of a reduced size which provides a communication between spaces 45, 46 left behind the both loudspeakers 41, 42. It is to be noted that the restricted space 44 represents a sound path for communicating the loudspeaker back sound pressure produced in one of the spaces 45, 46 to the other. The sound path space 44 has a suitable amount of sound absorbing material 47 disposed therein, and the combination of the space 44 and material 47 forms a low pass filter 48 which additively synthesize bass components of the both channels.

Figure 1:
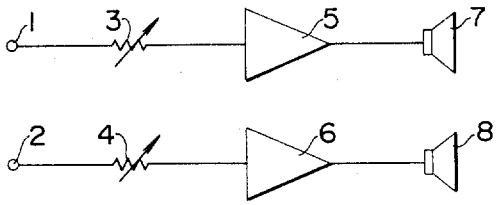
FIG. 1 is a schematic electrical diagram of a conventional acoustical reproducing apparatus.

When stereophonic signals are applied to the loudspeakers 41, 42 from the electrical circuit of the tape player 40, which may be constructed in its electrical arrangement as shown in FIG. 1, for example, the electrical output signals of the both channels are independently applied to these loudspeakers. Hence, when a low frequency signal of the L channel, for example, is applied to the input of the loudspeaker 41, it is not applied to the input of the other loudspeaker 42. As the loudspeaker 41 reproduces sound from the low frequency signal, a sound pressure is developed across the back thereof, which is introduced from the space 45 to the space 46 through the sound path space 44, whereby it is transmitted to the back surface of a paper cone 42*a* of the other loudspeaker 42. In this instance, the loudspeaker 42 functions as a passive radiator (drone cone). Specifically, in a specific low frequency range, the cone 42*a* of the loudspeaker 42 is driven by the back sound pressure of the loudspeaker 41 for resonance. Thereupon, a bass which is in phase with the bass radiated in front of the loudspeaker 41 is radiated from the front surface of the loudspeaker 42. When the R channel power amplifier is made to exhibit a high output impedance as by applying a negative current feedback in the manner mentioned in connection with FIG. 2, the loudspeaker 42 will be subject to little electromagnet braking, facilitating the vibration or resonance of the cone 42*a* of the loudspeaker 42 in response to the back sound pressure of the loudspeaker 41. Similarly, when the low frequency signal of the R channel is applied to the input of the loudspeaker 42, the reproduction of sound therefrom by the loudspeaker 42 causes the back sound pressure produced behind the loudspeaker 42 and in the space 46 to be introduced through the sound path space 44 into the space 45 to be transmitted to the back surface of the paper cone 41*a* of the loudspeaker 41, thus allowing the latter to reproduce a bass also.

In this manner, when one of the loudspeakers is supplied with and driven by a low frequency signal, the other loudspeaker resonates as a drone cone, thus doubling the radiant energy of the reproduction. However, as far as the tone pressure in the medium and the high frequency range is concerned, the back sound pressure developed behind the respective loudspeakers 41, 42 is sufficiently attenuated by the low pass filter 48 comprising the space 44 and sound absorbing material 47 to be little transmitted to the other loudspeaker 42, 41. Hence, a degradation in the stereophonic effect is avoided.

Figure 6:
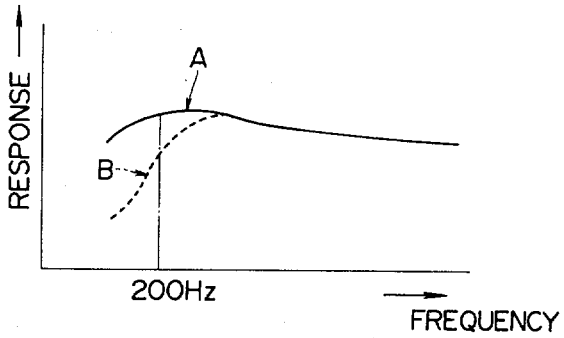
FIG. 6 graphically illustrates an example of the reproduction frequency response achieved with the present invention.

An acoustic reproducing apparatus which achieves an additive synthesis of low frequency components of the both channels either electrically or acoustically in the manners mentioned above exhibits a reproduction frequency response as indicated by a solid line curve A shown in FIG. 6. By contrast, a broken line curve B indicates a reproduction frequency response for the low frequency range exhibited by a conventional acoustic reproducing apparatus, as indicated in FIG. 1, in which no additive synthesis of low frequency components is made. It will be seen that the additive synthesis of low frequency components as performed in the present invention result in a significantly improved reproduction response for the low frequency range.

It should be understood that described embodiments are not limitative of the invention, but that a number of modifications are possible. By way of example, the negative feedback circuit including the resistors 17, 19 and resistors 18, 20 may be arranged to provide a bass boosting frequency selectivity. Alternatively, a combination of the electrical arrangement illustrated in FIGS. 2 and 3 may be combined with the acoustic arrangement illustrated in FIG. 5. Additionally, it should be understood that the invention is not limited in its use to a micro-cassette reproducing apparatus, but may be equally applied to a variety of stereophonic apparatus which are constrained to utilize loudspeakers of a small size for various reasons, if it is desired to improve the low frequency reproduction response as much as possible.

What is claimed is:

1. An acoustic reproducing apparatus including first and second channels connected to first and second speakers, comprising:

said first and second speakers being disposed in a housing, said housing having a sound path through which said first and second speakers are acoustically coupled, said sound path having sound absorbing material disposed therein to form a low pass filter for absorbing the high frequency signal component from said first and second speakers, said low pass filter operating to add the low frequency signal component of said first channel to said second channel, said low pass filter operating to add the low frequency signal component of said second channel to said first channel, whereby the low frequency signal components of said first and second channels are combined to produce a composite low frequency signal with greater amplitude which is reproduced in phase by each of said first and second speakers.

* * * * *